US005174657A

United States Patent [19]

Peppiatt

[11] Patent Number: 5,174,657

[45] **Date of Patent: * Dec. 29, 1992**

[54] DUPLEX BAG HAVING A HANDLE AND METHOD OF MAKING SAME

[75] Inventor: Harry R. Peppiatt, Doylestown, Pa.

[73] Assignee: Paramount Packaging Corporation, Chalfont, Pa.

[ * ] Notice: The portion of the term of this patent subsequent to Oct. 31, 2006 has been disclaimed.

[21] Appl. No.: 441,474

[22] Filed: Nov. 27, 1989

Related U.S. Application Data

[63] Continuation-in-part of Ser. No. 407,427, Sep. 14, 1989, abandoned, which is a continuation of Ser. No. 320,845, Mar. 6, 1989, Pat. No. 4,877,336, which is a continuation of Ser. No. 3,110, Jan. 14, 1987, abandoned, which is a continuation-in-part of Ser. No. 821,561, Jan. 21, 1986, Pat. No. 4,713,839, which is a continuation-in-part of Ser. No. 388,381, Jun. 14, 1982, Pat. No. 4,573,203.

[51] Int. Cl.[5] ..... B65D 30/20; B65D 33/10

[52] U.S. Cl. ..... 383/8; 383/21; 383/29; 383/109

[58] Field of Search ..... 383/8, 109, 29, 21, 383/25

[56] References Cited

U.S. PATENT DOCUMENTS

| | | | |
|---|---|---|---|
| 2,999,627 | 9/1961 | Reinhardt . | |
| 3,640,381 | 2/1972 | Kanada et al. . | |
| 3,738,567 | 6/1973 | Ruda . | |
| 4,573,203 | 2/1986 | Peppiatt . | |
| 4,738,546 | 4/1988 | Sengewald . | |
| 4,781,474 | 11/1988 | Sengewald | 383/29 |
| 4,854,733 | 8/1989 | Schwinn . | |
| 4,867,575 | 9/1989 | Wood . | |
| 4,874,255 | 10/1989 | Ball et al. . | |
| 4,877,335 | 10/1989 | Barnard | 383/21 |
| 4,877,336 | 10/1989 | Peppiatt | 383/8 |
| 4,877,337 | 10/1989 | Wood . | |

FOREIGN PATENT DOCUMENTS

| | | | |
|---|---|---|---|
| 1103624 | 6/1981 | Canada . | |
| 1411575 | 10/1968 | Fed. Rep. of Germany | 383/66 |
| 1275748 | 5/1972 | United Kingdom | 383/25 |
| 2131392 | 6/1984 | United Kingdom | 383/29 |

*Primary Examiner*—Stephen P. Garbe
*Attorney, Agent, or Firm*—Fitzpatrick, Cella, Harper & Scinto

[57] ABSTRACT

The present invention is directed to a duplex bag having a handle. The bag includes an inner and outer web of thermal plastic material. The outer web includes a front panel, a rear panel and a handle portion. The handle portion is integral with the front and rear panels and has a width less than the width of the front and rear panels. The inner web includes a front panel, a rear panel and a gusset portion. The gusset portion is integral with the front and rear panels and may have a line of perforations spaced from and parallel to the front and rear panels. All panels have about the same dimensions. The handle portion and the gusset portion may be adjacent one another at a top end of the bag. The front panel of the outer web overlies the front panel of the inner web and the rear panel of the outer web overlies the rear panel of the inner web. A side seam is formed at each lateral edge portion of said front and rear panels and seals the panels together.

6 Claims, 7 Drawing Sheets

FIG. 1
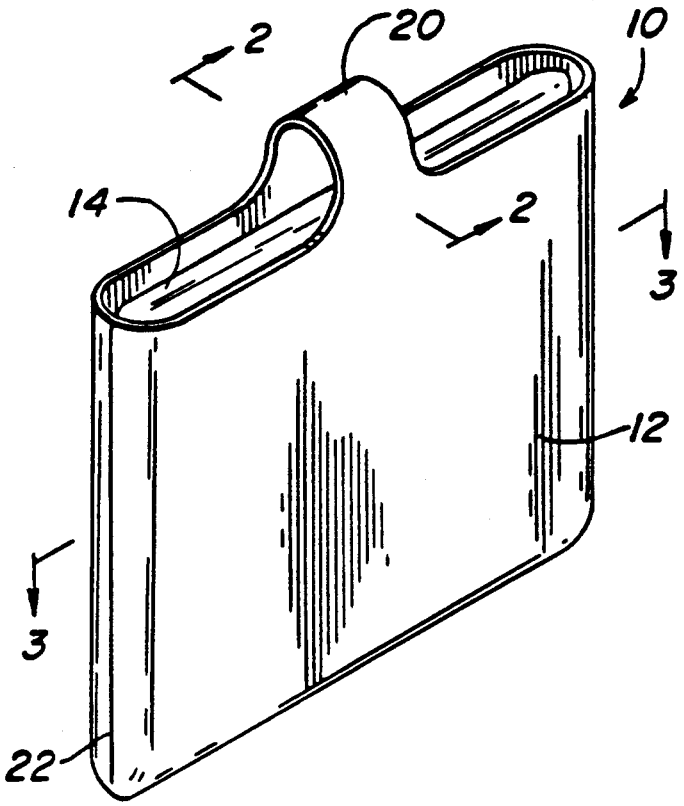
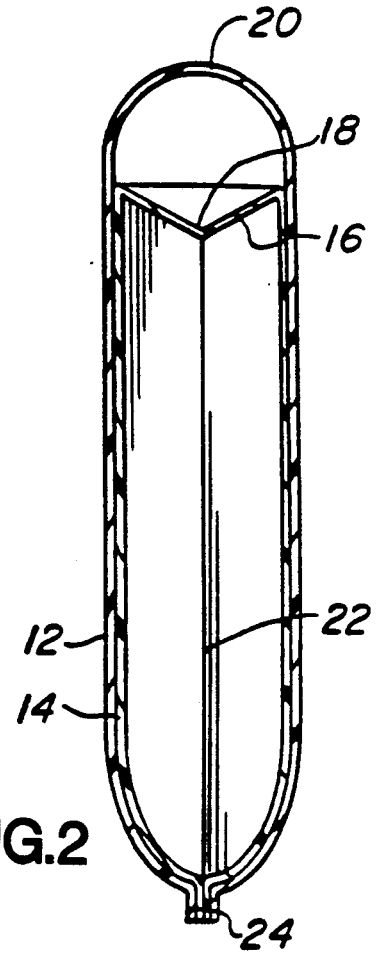
FIG.2
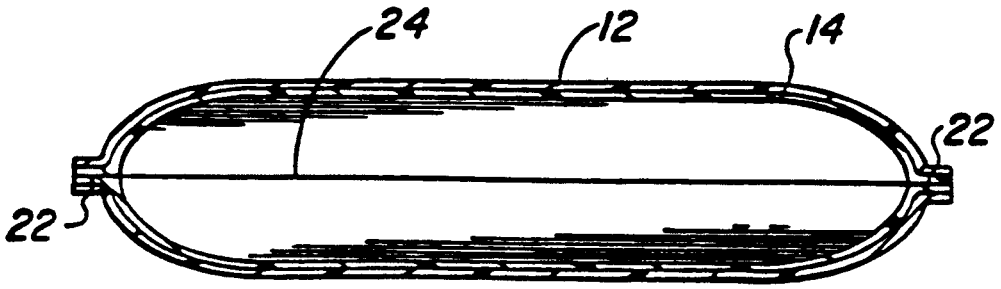
FIG.3

FIG.4
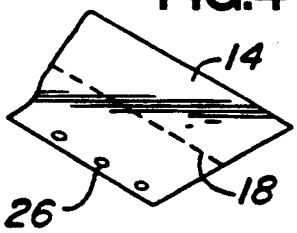
FIG.5
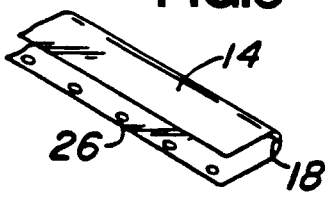
FIG.6
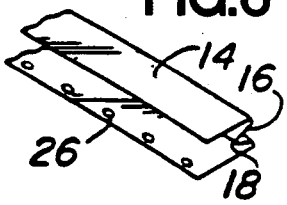
FIG.7
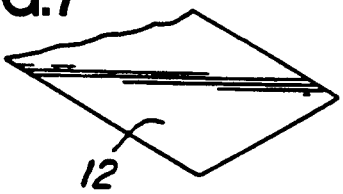
FIG.8
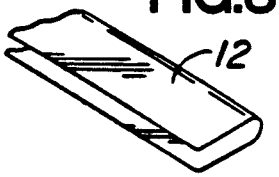
FIG.9
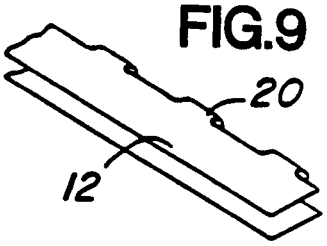
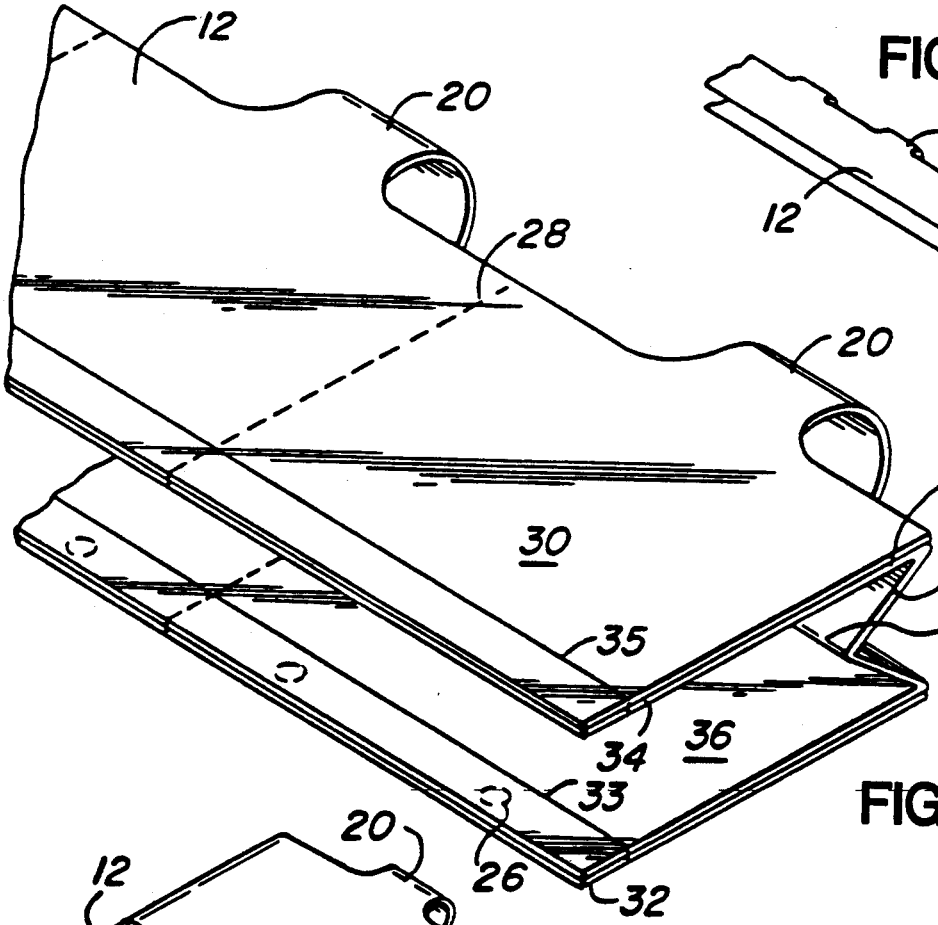
FIG.10
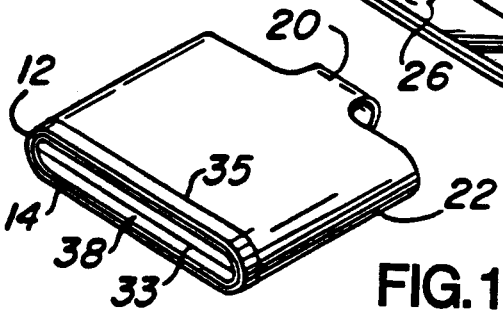
FIG.11

FIG.4a
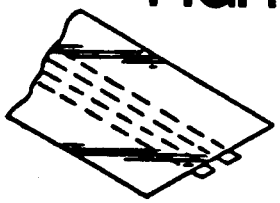
FIG.6a
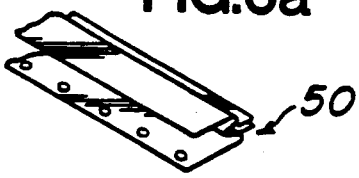
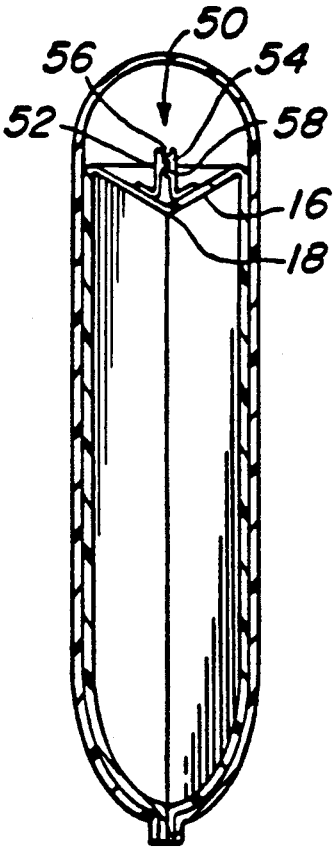
FIG.12
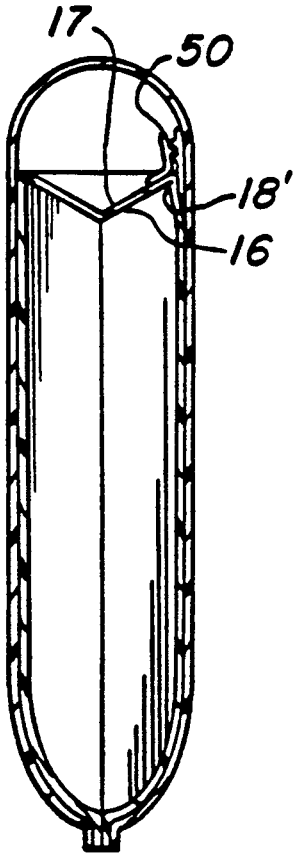
FIG.13

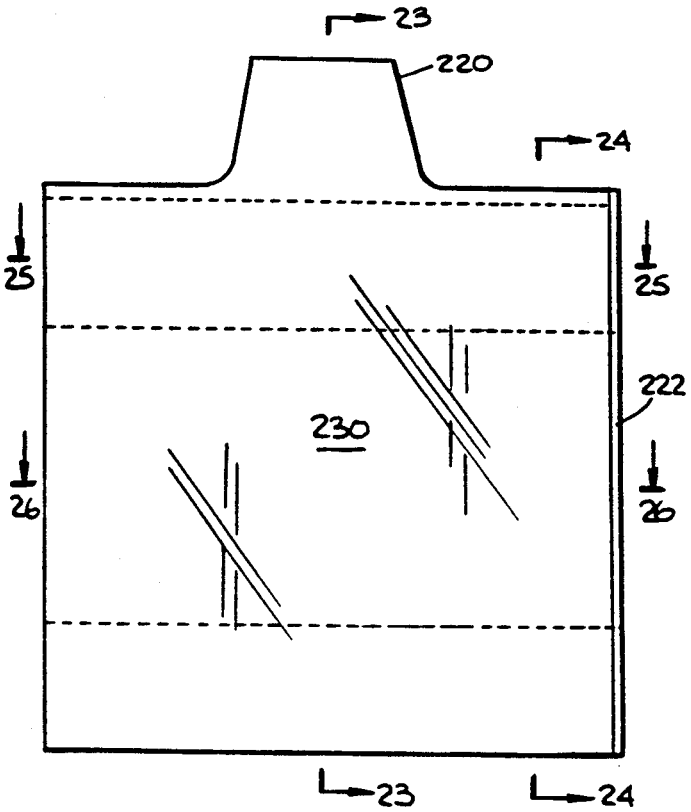
FIG.22
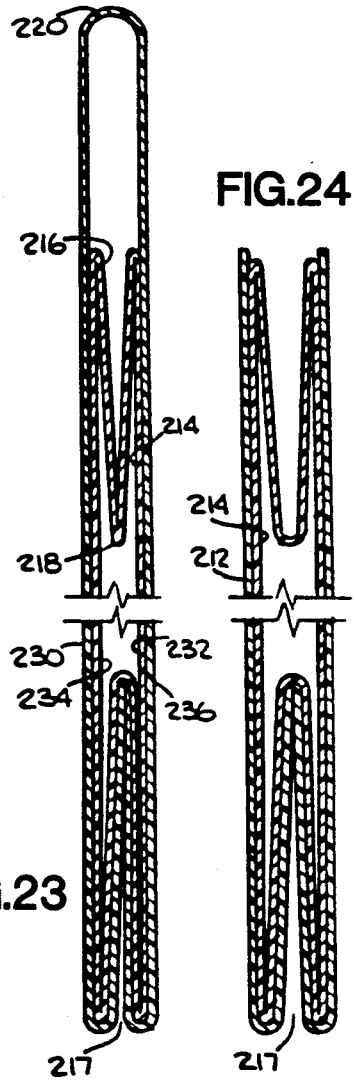
FIG.24
FIG.23
FIG.25
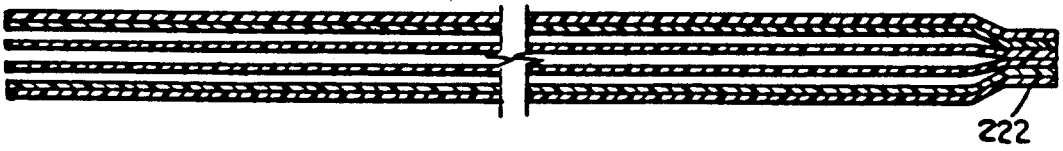
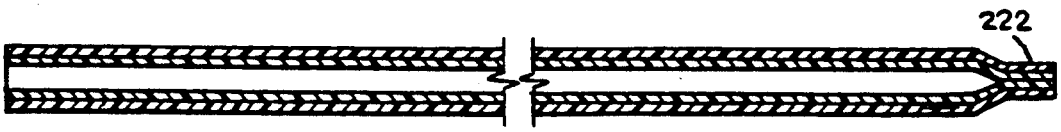
FIG.26

DUPLEX BAG HAVING A HANDLE AND METHOD OF MAKING SAME

This application is a continuation-in-part of application Ser. No. 407,427, filed Sep. 14, 1989, now abandoned, which is a continuation of application Ser. No. 320,845, filed Mar. 6, 1989, now U.S. Pat. No. 4,877,336, which is a continuation of Ser. No. 003,110, filed Jan. 14, 1987, now abandoned, which is a continuation-in-part of Ser. No. 821,561, filed Jan. 21, 1986, now U.S. Pat. No. 4,713,839, which is a continuation-in-part of Ser. No. 388,381, filed Jun. 14, 1982, now U.S. Pat. No. 4,573,203.

BACKGROUND OF THE INVENTION

1. Scope of the Invention

The present invention is directed to a bottom loaded or side loaded duplex bag having a handle. Also disclosed is a method for making the bag.

2. Background of the Invention

U.S. Pat. No. 1,808,375 discloses a shopping bag. The shopping bag has a front and rear panels which are joined together by a handle portion. The lateral side edges and bottom are joined together.

U.S. Pat. No. 3,580,486 discloses a plastic bag having an integral strap-like handle at its upper end and a bottom gusset or satchel bottom. The gusset unfolds under the weight of the items carried in the bag.

U.S. Pat. No. 4,573,203 discloses a plastic bag having a gusset located at its upper most end adjacent a loop handle. The loop handle is welded to the bag adjacent the upper edge portion of the bag.

SUMMARY OF THE INVENTION

The present invention is directed to a duplex bag having a handle. The bag includes an inner and outer web of thermal plastic material. The outer web includes a front panel, a rear panel and a handle portion. The handle portion is integral with the front and rear panels and has a width less than the width of the front and rear panels. The inner web includes a front panel, a rear panel and a gusset portion. The gusset portion is integral with the front and rear panels and has a line of perforations spaced from and parallel to the front and rear panels. All panels have about the same dimensions. The handle portion and the gusset portion are adjacent one another at a top end of the bag. The front panel of the outer web overlies the rear panel of the inner web, and the rear panel of the outer web overlies the rear panel of the inner web. A side seam is formed at each lateral edge portion of said front and rear panels and seals the panels together.

After the bag is filled, a bottom seam is formed at a bottom edge portion of the panels which seals the panels together. Additionally, a lip having a plurality of wicket holes may be located at the bottom edge portion of the bag. The lip having holes is used for holding the bag prior to filling and formation of the bottom seam.

The present invention is also directed to a duplex bag comprising an inner bag for containing the product and an outer bag supporting the inner bag. The inner bag comprises opposing panels and at least one fold portion connecting the opposing panels. The outer bag comprises opposing panels and at least a handle portion connecting the opposing panels. As used herein, "handle" has its customary broad meaning and refers not only to a loop handle through which a person may slip an arm to carry the duplex bag of this invention but also to other means which one can grasp for the purpose of carrying the bag; for example, a portion of plastic with holes, openings, or surfaces which fingers can grasp. The handle portion of the outer bag straddles a fold portion of the inner bag and provides support for the inner bag, and the inner and outer bags have substantially co-extensive openings to facilitate introduction of product into the inner bag. The duplex bag of the invention is also directed to a duplex bag in which the four opposing panels of the inner and outer bags are sealed together along at least one common edge portion of the panels.

The present invention is also directed to method of making a duplex bag. In one method of this invention a thermal plastic web is provided for an inner bag and at least one fold is provided in the web for the inner bag. A thermal plastic web is also provided for an outer bag and at least one fold is provided in the web for the outer bag, and a handle is formed in one fold portion in the outer web. The folded inner web and the folded outer web are then joined such that the inner web forms an inner bag with an open end portion and the outer web forms an outer bag with an open end portion, the handle portion of the outer web straddling the fold portion of the inner web.

DESCRIPTION OF THE DRAWINGS

For the purpose of illustrating the invention, there is shown in the drawings forms which are presently preferred; it being understood, however, that this invention is not limited to the precise arrangements and instrumentalities shown.

FIG. 1 is an isometric view of a preferred embodiment of the present invention.

FIG. 2 is a sectional view of the bag shown in FIG. 1 taken generally along sectional lines 2—2.

FIG. 3 is a sectional view of the bag shown in FIG. 1 taken generally along lines 3—3.

FIGS. 4–6, **4*a* and 6*a*** schematically illustrate the formation of an inner web in one preferred process of the invention.

FIGS. 7–9 schematically illustrate the formation of an outer web in one preferred process of the invention.

FIG. 10 is an isometric view of a preferred embodiment prior to welding the lateral seams.

FIG. 11 is an isometric view of a preferred embodiment prior to filing and formation of the bottom seal.

FIG. 12 is a sectional view of an alternate embodiment of the present invention.

FIG. 13 is a sectional view of another alternate embodiment of the present invention.

FIG. 22 is a view of another preferred embodiment of the present invention.

FIGS. 23 to 26 are sectional views of the bag shown in FIG. 22 taken generally along sectional lines 23—23, 24—24, 25—25 and 26—26 respectively.

DETAILED DESCRIPTION OF THE INVENTION

Figure 14:
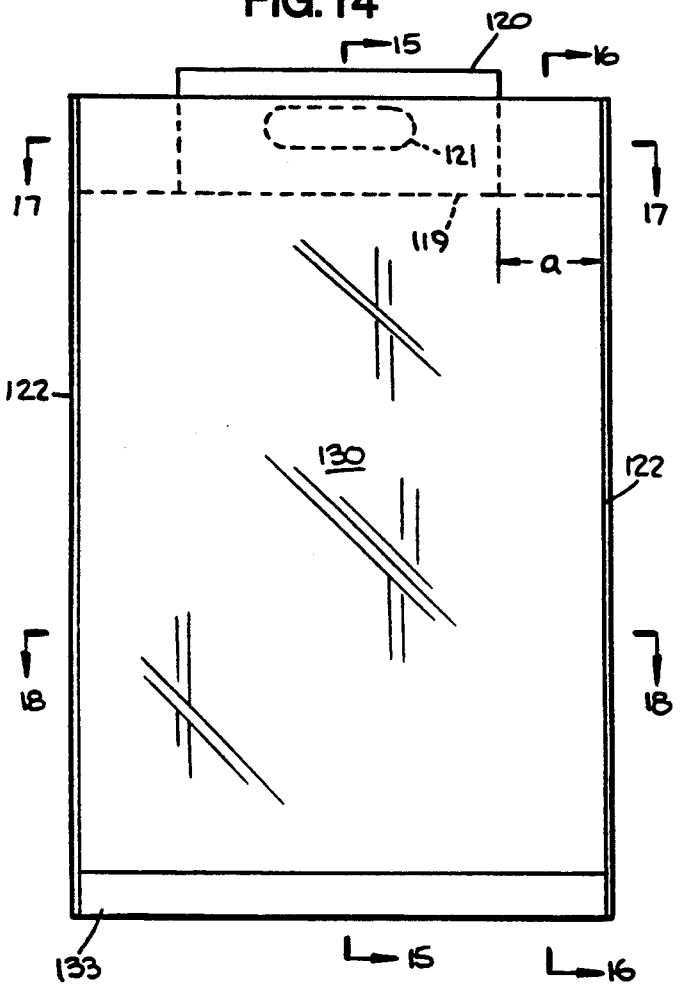
FIG. 14 is a view of another preferred embodiment of the present invention
Figure 15:
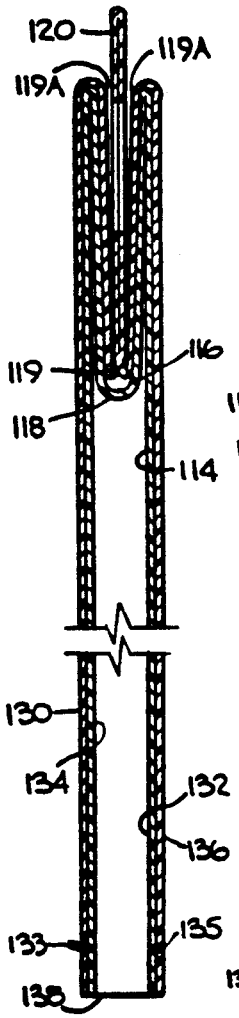
FIGS. 15 to 18 are sectional views of the bag shown in FIG. 14 taken generally along sectional lines 15—15, 16—16, 17—17, and 18—18 respectively.
Figure 16:
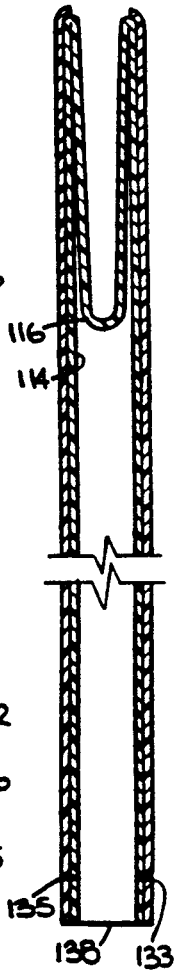
Figure 17:
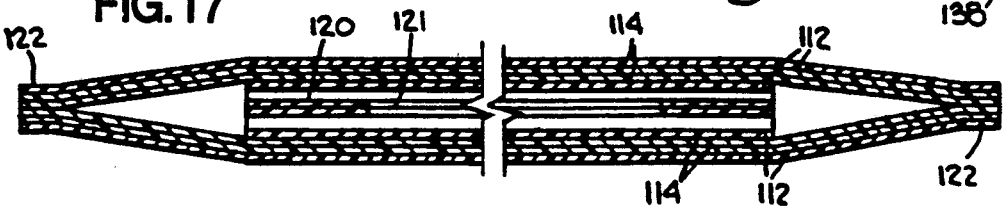
Figure 18:
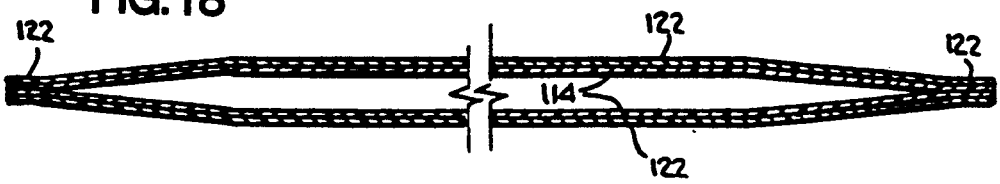
Figure 19:
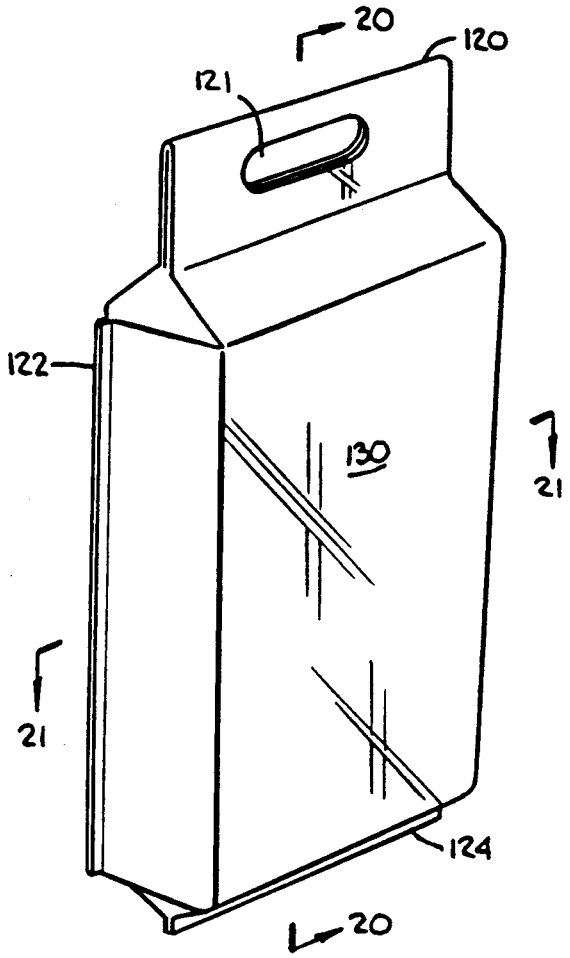
FIG. 19 is an isometric view of the preferred embodiment of FIG. 14 when filled with product.
Figure 20:
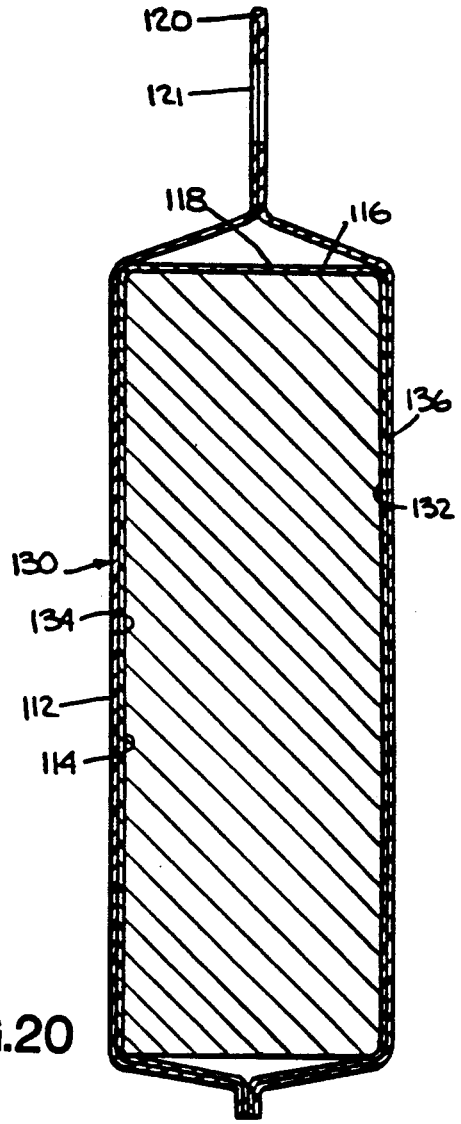
FIGS. 20 and 21 are sectional views of the bag shown in FIG. 19 taken generally along sectional lines 20—20 and 21—21 respectively.
Figure 21:
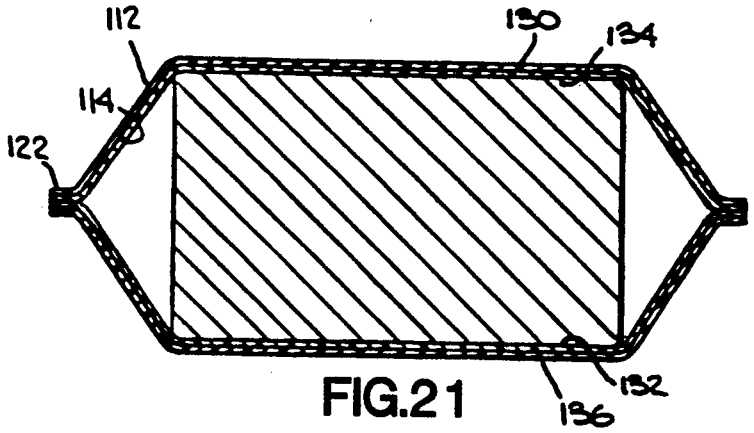
Figure 28:
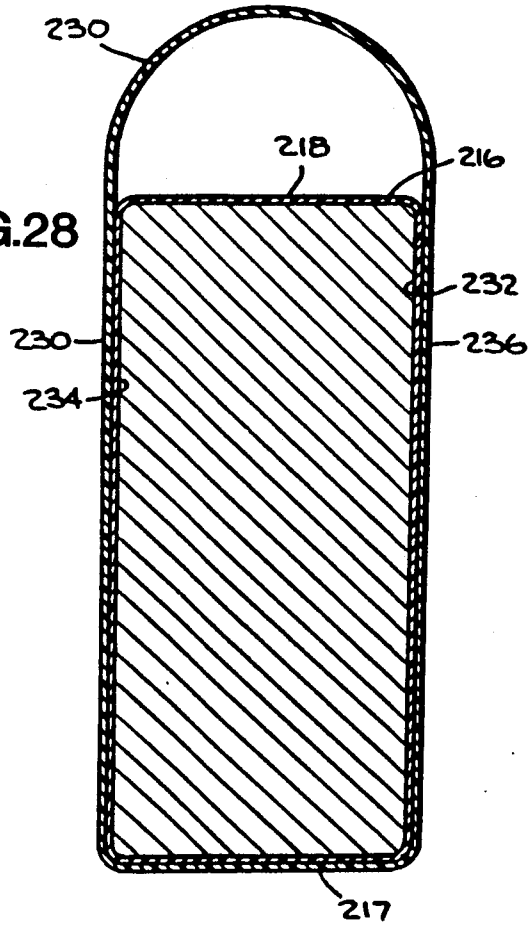
FIGS. 28 and 29 are sectional views of the bag shown in FIG. 27 taken generally along sectional lines 28—28, 29—29 respectively.
Figure 27:
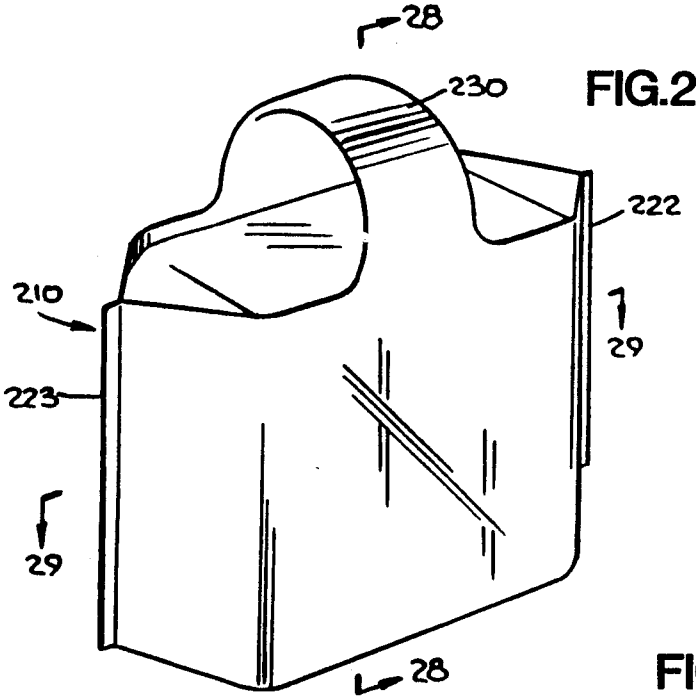
FIG. 27 is an isometric view of the preferred embodiment of FIG. 22 when filled with product.
Figure 29:
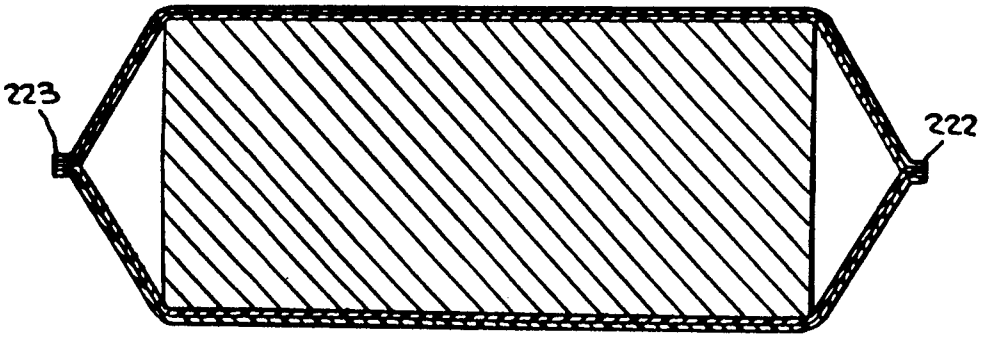

Referring to the drawings where like numerals indicate like elements, there is shown in FIG. 1 a preferred embodiment of the duplex bag generally designated 10.

Duplex bag 10 comprises an inner web 14 and an outer web 12. Outer web 12 includes a handle portion 20. Inner web 14 preferably includes a gusset 16. A line of perforations 18 is preferably formed at the apex of gusset 16. The line of perforations 18 may be severed whereby materials within bag 10 may be retrieved or inserted.

The webs 12 and 14 are made of thermal plastic material which is weldable. Webs 12 and 14 are welded together at lateral seams 22 and bottom seam 24. Seams 22 and 24 may be formed in any conventional manner such as but not limited to thermal welding, ultrasonic welding, electronic welding, etc. The seams and joints described herein may be glued, but this is not preferred.

The outer web 12 may be made of low millage material. Regardless of the low millage material, the bag is still strong. The formation of seams 22 and 24 about the periphery of the bag 10 allows the stress at the joining points of the handle 20 and panels of web 12 to be evenly distributed over the entire web 12. Accordingly, the bag can be used for such heavy items as charcoal, fresh potatoes, diapers or sanitary products, garden products, etc.

Referring to FIGS. 4–6, the formation of inner web 14 is explained. Web 14 is generally formed from a continuous web of thermal plastic material. The line of perforation 18 may bifurcate web 14 along the longitudinal axis. The web 14 is then folded over onto itself along the line of perforations 18. See FIG. 5. Alternately, a plurality of wicket holes 26 may be disposed along a lateral edge portion or lip of web 14 parallel to the line of perforations 18. Wicket holes 26 are used for holding the bag loading. If the wicket holes 26 are used, then the line of perforations is offset from the longitudinal axis and the web 14 is folded at the line 18 whereby a lip having the wicket holes 26 is formed.

After web 14 has been folded over on itself as shown in FIG. 5, gusset 16 is preferably formed along a line of perforations 18 at the folded portion of the bag. The line of perforations 18 is located along the apex of gusset 16.

Referring to FIGS. 7–9, the formation of outer web 12 is disclosed. Web 12 is formed from a continuous strip of thermal plastic material. See FIG. 7. Web 12 is folded over onto itself along the longitudinal axis or can be folded over folded web 14. See FIG. 8. Handle 20 is formed along the folded portion of web 12 preferably by diecutting. Of course other methods may be used for forming the handle 20.

Referring to FIG. 10, there is an illustration of the orientation of the outer web 12 and the inner web 14 immediately prior to the welding/lateral seam formation operation. While the inner and outer webs are shown in FIG. 10 to be exactly co-extensive, as mentioned above it is sufficient if they are substantially co-extensive. For example, in order to facilitate use of wicket holes, to utilize certain printing equipment, or for other reasons, the inner and outer webs may be offset as much as is necessary to achieve desired purposes.

Longitudinal welds 33 and 35 are preferably made adjacent an opening 38 of bag 10. Weld 33 joins front and top panels 30, 34. Weld 35 joins rear and bottom panels 32, 36. Welds 33, 35 are made in any well known manner. Welds 33, 35 prevent materials, added to bag 10 during loading, from falling between the panels of the inner and outer panels.

Web 12 includes a front panel 30 and rear panel 32 which are joined together by handle portion 20. Front panel 30 and rear panel 32 are preferably rectangular and have the same general dimensions. The handle portion 20 has a width which is preferably narrower than the width of the front and rear panels 30 and 32.

Inner web 14 comprises a front panel 34, a rear panel 36 and the gusset portion 16. Gusset portion 16 is integral with and joins front and rear panels 34 and 36. Front and rear panels 34 and 36 are preferably rectangular and have the same general dimensions.

Front and rear panels 30 and 32 and front and rear panels 34 and 36 all preferably have the same general dimensions.

Front panel 30 overlies front panel 34. Rear panel 32 overlies rear panel 36. Handle portion 20 and gusset portion 16 are adjacent a top portion of the bag.

Lateral seams 22 are formed along seam line 28. Seam line 28 is generally perpendicular to perforated line 18. The welding operation which forms lateral seams 22 severs one bag 10 from the next and seals the panels 30, 34, 36 and 32 together.

FIG. 11 shows a preferred embodiment of the present invention prior to the formation of a bottom seam 24. Bag 10 includes a bottom opening 18. Materials are filled into bag 10 via opening 38. If the embodiment having the lip and wicket holes 36 is utilized, then during the formation of the bottom seal 26 the lip is severed from the bag 10.

FIGS. 12 and 13 illustrate two alternate embodiments of the present invention in which a closure means 50 is attached adjacent to the gusset 16. The closure means 50 includes a male member 52 and a female member 54. The male and female members 52, 54 may be joined together thereby forming a seal which closes the bag. Male and female members 52, 54 may be separated thereby allowing access to the bag. Male member 52 includes a longitudinal rib 56 which is adapted for a press-lock fit in a groove 58 of female member 54.

The embodiment illustrated in FIG. 12 has the closure means 50 straddling perforated line 18. The male member 52 is welded to a portion of the gusset 16 on one side of line 18 and female member 54 is welded to a portion of the gusset 16 on the other side of line 18. After the bag 10 is loaded and opening 18 is sealed, the closure means 50 can be opened and perforated line 18 separated. This allows access into the bag. The closure means 50 can be sealed, thereby closing the bag. The method of making the bag illustrated in FIG. 12 is generally the same as discussed above. However, the closure means 50 may be joined to the inner web 14 prior to the first folding step. (See FIG. 4*a*). The male and female members 52, 54 are joined to web 14 on either side of the perforated line 18 in any conventional manner.

The embodiment illustrated in FIG. 13 is generally the same as the embodiment of FIG. 12. However, the closure means 50 (the same as previously described) is adjacent the front (or rear) panel. The perforated line 18 is eliminated and new perforated line 18' is formed. One member of the closure means 50 is welded to a side 17 of gusset 16. The other member of the closure means 50 is welded to the panel of the inner web and is between panels of the inner and outer web. The method of making this embodiment is generally the same as the originally described method. However, the closure means 50 may be joined to the inner web after or with the formation of the gusset 16. (See FIG. 6*a*).

The bag shown in FIGS. 14 to 21 has a handle for the outer bag generally of the kind shown in U.S. Pat. No. 4,252,269. As with other bags of this invention one can make the inner web have properties that are appropriate for holding the product, while making the outer web have different properties that are appropriate for supporting the product in the inner bag. In addition, the embodiment of FIGS. 14 to 21 eliminates a problem with the bags of U.S. Pat. No. 4,252,269. When bags of that patent are filled, stresses from the handle have a tendency to concentrate at the apex on the side seams where the center portion of the gusset meets the side. Since the outer bag web for the handle may be cut back from the side seams in the embodiment of FIGS. 14 to 21, those stresses do not form.

The bag of FIGS. 14 to 21 comprises an inner web 114 and an outer web 112. The webs are made of thermal plastic and welded together at lateral seams 122 and bottom seam 124. The duplex bag formed generally as shown in FIGS. 4 to 10 except that, following the steps of U.S. Pat. No. 4,252,269, which is incorporated herein, the outer web 112 is sealed to itself at 119. In this embodiment of the invention, the portion of the outer web at "a" (see FIG. 14) is cut out from the outer web to the opposing panels 130 and 136. The inner web is then folded inward at fold 118, and the outer web is folded inward at fold 119 to form a gripping surface handle 120 that facilitates carrying the bag. The outer web thus makes up a bag having opposing panels 130 and 136, and the inner web makes up an inner bag having opposing panels 132 and 134. The outer bag handle 120 and handle piece 119A connect opposing panels 130 and 136 and straddle the folded portion 118 and 116 of the inner bag, comprising panels 132 and 134. The handle portion (120 and 119A) of the outer bag is longer than the fold portion (116 and 118) of the inner bag.

In FIGS. 14 to 21, weld 133 joins front panels 130 and 134, and weld 135 joins rear panels 132 and 136. Product may then be introduced into the bag through opening 138. In the embodiment of FIGS. 14 to 21 the web between opposing panels is sealed to itself at 119 to create two handle portions 120 and 119A. The handle 120 portion may be provided with an opening 121 to facilitate gripping and carrying the bag. If the distance "a" shown in FIG. 14 is about one-half the distance of the fold portion 116 between, its opposing panels, when the bag 110 is filled the first part of handle portion will cover most of the top portion of the inner bag.

The bag of FIGS. 22 to 29 has the advantage of no filling seam on the bottom (the side opposite the handle). The only seams on the bottom or otherwise taking the stresses of carrying are seams made under controlled conditions at the time of or before manufacture of the bag, and such seams are stronger than seams made at the time of filling and packing. This provides better strength and weight carrying properties. The bag of FIGS. 22 to 29 comprises an inner web 214 and an outer web 212. The webs are made of thermal plastic, formed into individual tubes at a seam not shown, and welded together at lateral seam 222. The duplex bag is formed generally as shown in FIGS. 4 to 10 except that they are formed into tubes with no opening in the area of welds 33 and 35. The inner web is folded inward at fold 218, and the outer web is formed into handle 220 that facilitates carrying the bag. The outer web thus makes up a bag having opposing panels 230 and 236, and the inner web makes up an inner bag having opposing panels 232 and 234. The outer bag handle 220 connects opposing panels 230 and 236 and straddles the folded portion 218 of the inner bag, comprising panels 232 and 234. During manufacture of the bag only one side seam (222) is sealed and the opposite side is left open to facilitate filling with product. Once filled, this opening 238 is closed and sealed to form seam 223.

The duplex bags of this invention may be manufactured at high speed on automatic machinery. Because of the use of two layers and the stress distribution properties of the design, savings in raw materials are possible while at the same time permitting flexibility in packaging and the possibility of additional features. For example, a vacuum may be drawn on the inner bag, coupons may be placed between layers of the bag, and the inner web may have breathing holes for fresh produce without sacrificing strength in the outer supporting bag. The flexibility of this invention also permits the inner bag to have, for example, a reclosure as a convenience to the purchaser.

A variety of perforation and opening arrangements is possible. In addition to the closure means of FIGS. 12 and 13, pressure sensitive tape or other recloseable sealing means may be used. Such recloseable means may be placed anywhere on the inner bag as may suit the product, and perforations may be arranged to provide primary seals that are tamper evident in the store but cover secondary seals (such as in FIGS. 12 and 13) which may be used by the purchaser at home for reclosure. Perforations may be placed on the folds 16, 116 and 216, as illustrated, but also in the side, front, or back panels. Perforations on the inside bag may be offset with respect to perforations on the outside bag and thereby provide both protection of the product and a degree of access to the product by manipulating a hand through two non-aligned openings without permitting the contents to fall freely from the bag.

Sealing patterns may also be varied. While the bags described above are shown with continuous seals at seams between the inner and outer webs, spot sealing elsewhere on the panels to increase dimensional stability or registration of the two bags is also contemplated. The inner bag may have vents for fresh produce, to permit out-gassing, and/or to reduct trapped air. While continuous seals for the seams are shown, it will be understood that there may be circumstances where partial seals may be advantageous. Additionally, access to the space between the inner and outer bags may be arranged so that the bag can receive and carry additional items, such as coupons inserted by the manufacturer of the goods packaged in the bag, or bottles or other items inserted by the purchaser of the bag after the bag has been opened. Verticle and other seals between the inner and outer bags can create pockets for receiving such items, which facilitate this use.

While the handle is shown in some figures without cut-outs, cut-outs to facilitate gripping may be used. Similarly, the width and the length of the handle may be varied to suit the user. We contemplate, for example, a handle that can be slipped over the arm either along the long axis of the package (as shown in FIG. 1) or, because of additional holes, finger grips, or the like at right angles to that axis The present invention may be embodied in other specific forms without departing from the spirit or essential attributes thereof and, accordingly, reference should be made to the appended claims, rather than to the foregoing specification, as indicating the scope of the invention.

What is claimed is:

1. A duplex bag comprising:

an inner bag for containing product, an outer bag supporting the inner bag, the inner bag comprising opposing panels and at least one fold portion connecting the opposing panels, the outer bag comprising opposing panels and an integral handle portion connecting the opposing panels, the outer bag handle portion straddling the fold portion of the inner bag and providing additional support for the inner bag, and the inner and outer bags having openings that are at least partially coextensive to facilitate introduction of product into the inner bag.

2. The bag of claim 1 in which the four opposing panels of the inner and outer bags are sealed together along at least one common edge portion of the panels.

3. The bag of claim 1 in which the handle portion is perpendicular to the opening for introduction of product.

4. A duplex bag comprising:

an inner bag;

an outer bag enclosing at least a portion of the inner bag;

the inner bag comprising opposing panels and a folded portion connecting the opposing panels;

the outer bag comprising opposing panels and an integral handle portion connecting the opposing outer bag panels;

the outer bag handle portion straddling the folded portion of the inner bag and providing additional support for the inner bag; and each of the inner and outer bags having an opening therein to provide access to an interior of the inner bag.

5. A bag according to claim 4 wherein the inner and outer bags have substantially coextensive boundaries along left, right, and bottom edges thereof.

6. A bag according to claim 4 wherein the openings in the inner and outer bags are substantially coextensive.

* * * * *

UNITED STATES PATENT AND TRADEMARK OFFICE

CERTIFICATE OF CORRECTION

PATENT NO. : 5,174,657

DATED : December 29, 1992

INVENTOR(S) : PEPPIATT

It is certified that error appears in the above-identified patent and that said Letters Patent is hereby corrected as shown below:

Column 1

Line 31, "upper most" should read --uppermost--.

Column 3

Line 38, "perforation 18" should read --perforations 18--.
Line 44, "loading." should read --during loading.--.

Column 5

Line 28, "formed" should read --is formed--.
Line 38, "a bag," should read --an outer bag--.
Line 55, "between," should read --between--.

Column 6

Line 7, "a bag" should read --an outer bag--.
Line 52, "reduct" should read --reduce--.
Line 61, "Verticle" should read --Vertical--.

Signed and Sealed this

Seventh Day of December, 1993

Bruce Lehman

*Attest:*

BRUCE LEHMAN

*Attesting Officer*

*Commissioner of Patents and Trademarks*